US006135818A

United States Patent [19]

Lang et al.

[11] Patent Number: 6,135,818

[45] Date of Patent: Oct. 24, 2000

[54] DIE CAST ELECTRICAL CONNECTOR SHELL WITH INTEGRAL TRAPEZOIDAL SHIELD AND OFFSET CABLE GRIPPING TEETH, AND ELECTRICAL CONTACT ARRANGEMENT THEREFOR

[75] Inventors: Roger J. Lang; John Majernik, both of Endicott, N.Y.

[73] Assignee: Amphenol Corporation, Wallingford, Conn.

[21] Appl. No.: 09/149,490

[22] Filed: Sep. 8, 1998

Related U.S. Application Data

[63] Continuation of application No. 08/788,777, Jan. 24, 1997, Pat. No. 5,848,914.

[51] Int. Cl.[7] ..... H01R 13/648

[52] U.S. Cl. ..... 439/610

[58] Field of Search ..... 439/607–610

[56] References Cited

U.S. PATENT DOCUMENTS

| | | | |
|---|---|---|---|
| 2,519,726 | 8/1950 | Wollard | 200/157 |
| 3,375,481 | 3/1968 | Parnell | 339/94 |
| 3,909,101 | 9/1975 | Bruels | 339/107 |
| 4,272,148 | 6/1981 | Knack, Jr. | 439/610 |
| 4,293,180 | 10/1981 | Taylor | 339/217 |
| 4,640,984 | 2/1987 | Kalbfeld | 174/135 |
| 4,678,256 | 7/1987 | Nishino et al. | 439/347 |
| 4,689,723 | 8/1987 | Myers et al. | 361/424 |
| 4,786,260 | 11/1988 | Spaulding | 439/607 |
| 4,822,304 | 4/1989 | Herron | 439/610 |
| 4,846,724 | 7/1989 | Sasaki et al. | 439/610 |
| 4,854,890 | 8/1989 | Nishimura | 439/607 |
| 4,921,441 | 5/1990 | Sauder | 439/460 |
| 4,963,104 | 10/1990 | Dickie | 439/610 |
| 5,055,070 | 10/1991 | Plegge et al. | 439/610 |
| 5,108,294 | 4/1992 | Marsh et al. | 439/76 |
| 5,108,313 | 4/1992 | Adams | 439/610 |
| 5,195,909 | 3/1993 | Huss, Jr. et al. | 439/610 |
| 5,244,415 | 9/1993 | Marsilio et al. | 439/610 |
| 5,364,292 | 11/1994 | Bethurum | 439/610 |
| 5,505,637 | 4/1996 | Krämer et al. | 439/610 |

*Primary Examiner*—Hien Vu

*Attorney, Agent, or Firm*—Blank Rome Comisky & McCauley, LLP

[57] ABSTRACT

A die cast metal shell for an electrical connector is made up of a base and cover. Cable braid deforming teeth are die cast into a cable entry passage at the rear of the shell, and a thin wall front shield is integrally die cast with the base to provide a low resistance path between the cable braid and the front shield. A circuit board may be positioned in a backshell portion of the base, the circuit board including traces to which wires of the cable are terminated and extending forwardly from the backshell through a relatively narrow front opening to form a set of contacts for the connector.

9 Claims, 4 Drawing Sheets

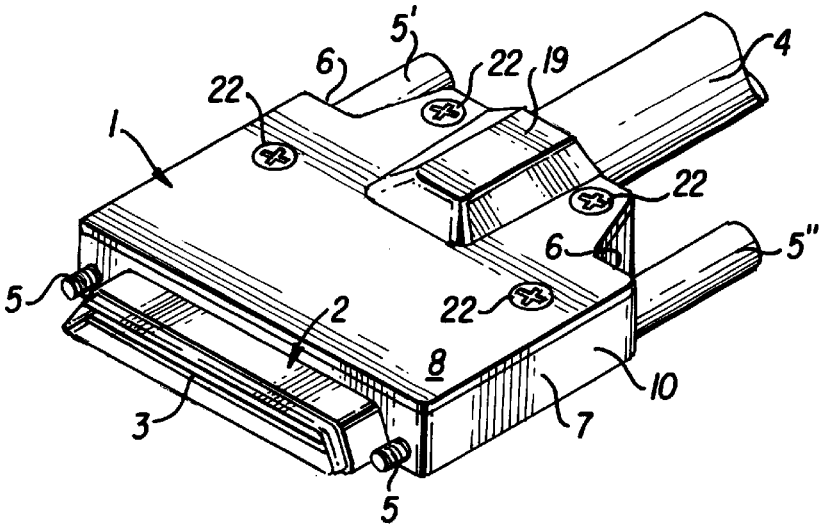
FIG. 1
FIG. 2
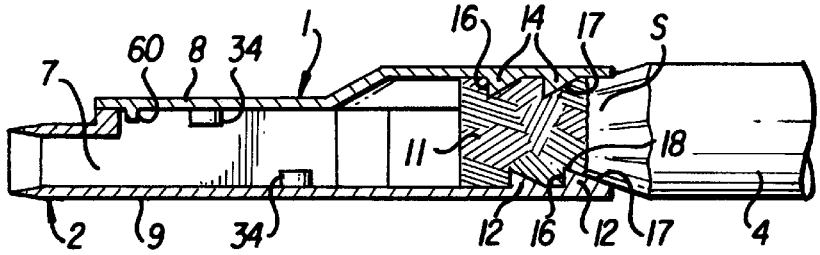
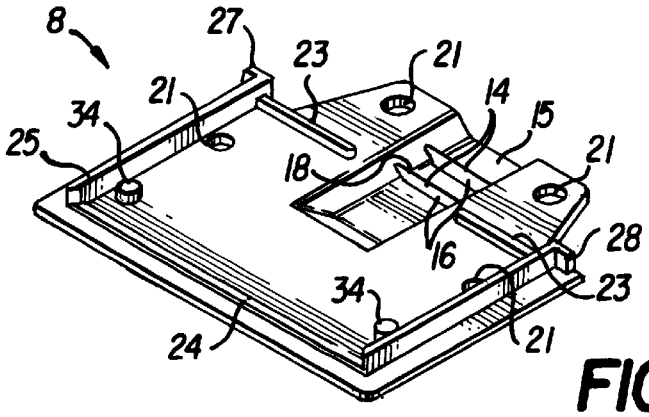
FIG. 3

DIE CAST ELECTRICAL CONNECTOR SHELL WITH INTEGRAL TRAPEZOIDAL SHIELD AND OFFSET CABLE GRIPPING TEETH, AND ELECTRICAL CONTACT ARRANGEMENT THEREFOR

This application is a continuation of U.S. patent application Ser. No. 08/788,777, filed Jan. 24, 1997, now U.S. Pat. No. 5,848,914 and now allowed.

BACKGROUND OF THE INVENTION

1. Field of the Invention

This invention relates to an electrical connector shell, and in particular to a die cast electrical connector shell including an integral shield and integral cable gripping teeth. The invention also relates to a shielded electrical connector of the type used to terminate a cable having a braided outer conductor, and in particular to a shielded electrical connector having improved braid-to-shield continuity and an improved contact arrangement. Finally, the invention also relates to a contact arrangement for an electrical connector which eliminates the need for a dielectric contact housing structure.

2. Discussion of Related Art

Cables made up of multiple individual wires surrounded by a braided outer conductor are used as data buses in computer applications. The cables are terminated by means of connections surrounded by a metal shell, the shell being electrically connected at the rear to a braided outer conductor and at the front to a shield which surrounds the connector contacts and establishes and electrical connection with the shell or housing of a mating connector or component, and the wires are terminated by a contact structure which includes a dielectric support and contacts extending through an opening between the metal shell and the front shield.

The purpose of the electrical connections between the cable braid and connector shell, and between the shell and contact shield, is to provide shielding continuity and prevent leakage of radiation generated by signals carried by wires in the cable and the contacts extending from the metal shell to the shield.

There are generally two areas in a conventional data bus connector where shielding continuity may be disrupted. The first at the seam between the relatively thick metal shell which houses the cable termination and the thinner front shield which surrounds the contacts and establishes electrical contact with the corresponding mating connector or component. While elimination of the seam between the connector shell and front shield in this type of connector has not previously been addressed, various alternative cable braid termination arrangements have been used or proposed.

The usual practice for terminating the cable braid to the connector shell is to use a crimp ring method, in which the crimp ring is compressed in the rear passage of the backshell to establish electrical continuity between the shell and cover and provide strain relief, or to use either a separate staple which is driven down over the braid or a clamp which is placed over the braid and secured by two screws. These termination methods are relatively costly and complicate the assembly process, however.

A simpler cable termination arrangement is disclosed in U.S. Pat. No. 5,244,415 (the '415 patent). The connector described in this patent consists of a die cast metal backshell made up of a base and cover, a rear section having integral cable gripping structures extending into a passage through which the cable enters the shell, and an opening at the front side of the die cast shell for receiving a thin wall trapezoidal shield member which accommodates the contacts and is mated with a corresponding connector or component housing.

More specifically, termination of the die cast metal shell to the outer braid of the cable is accomplished in the connector of the '415 patent by means of ribs extending inwardly from a wall in the base and tabs depending from the upper at a position between the ribs to form a passage into the chamber, the distance between the ribs and tabs being narrower than the normal diameter of the outer braid so that the outer braid is compressed horizontally by the ribs upon placement of the cable between the ribs of the base, and compressed horizontally by the tabs and vertically by the upper and lower walls of the passage formed upon attachment of the cover to the base, establishing an connection between the braid and the backshell and providing strain relief. To improve electrical continuity, the '415 patent depicts placement of a ring of copper foil, described as being optional, around the cable braid in the area of termination.

The present invention replaces both the conventional crimp ring, staple, or foil cable braid termination arrangements and the arrangement disclosed in the '415 patent, and also addresses the problem of shielding continuity at the seam between the metal shell and the thin wall front shield, by integrating into the metal shell a set of offset cable gripping teeth as well as the front shield. The offset cable gripping teeth are arranged to deform the cable braid to establish a low resistance electrical connection while at the same time minimizing stress on individual wires in the cable, reducing the problem of short circuits or unacceptable impedance changes in the signal-carrying wires, while integration of the front shell establishes a completely seamless path between the cable braid termination and the mating portion of the connector to eliminate resistance and RF leakage at the metal shell-to-shield interface. In addition, the present invention provides an improved contact arrangement which is especially suitable for use in such an electrical connector, and which does not require a dielectric housing structure for the contacts.

There are of course electrical connectors in which a mating front portion is integral with the rear portion of the connector, including cylindrical connectors, BNC connectors, and so forth. However, connectors of the type employing a thin wall front shield have consistently used a separate shield, as described in numerous patents, including the '415 patent and U.S. Pat. Nos. 4,678,256, 4,689,728, 4,786,260, 4,822,304, 4,854,890, 4,921,441, and 5,108,294, all of which disclose cable connectors having discrete or separate trapezoidal shield arrangements, rather than integral front shields, and which therefore cannot provide optimal electrical continuity between the outer conductor of the cable and the shield.

Also known are electrical connectors which include cable gripping teeth arranged to deform the outer jacket of a cable, as in the present invention, and connectors with offset cable gripping structures. However, the advantages of combining integral cable gripping teeth and offset cable gripping structures does not appear to have been previously recognized, and particularly not in the context of a metal connector shell for a shielded multiple wire cable.

Typical of the previously disclosed offset cable gripping structures is the one disclosed in U.S. Pat. No. 4,640,984 (the '984 patent). While the cable gripping structures described in this patent are offset from each other along the axis of the cable, as in the present invention, the cable gripping structures are not cable gripping teeth arranged to deform the cable, and the context in which the gripping structures are disclosed is not that of a connector shell. Instead the cable gripping structures described in the '984 patent are used in a strain relief structure in which the cable is intentionally bent to form a serpentine path which retains the cable. The cable gripping structures of the '984 patent do not have the function of providing an electrical connection between an outer cable shield and the housing of the device, and the cable disclosed in the patent is a flat cable for which stresses on the inner wires are apparently not considered a problem. In contrast to the purposeful bending of this type of strain relief, which substitutes for cable penetration, the present invention keeps overall bending of the cable, as it traverses the passage into the shell, to the minimum necessary to ensure electrical contact and strain relief.

On the other hand, in cases where the connector is provided with teeth arranged to penetrate the cable, the teeth are not integral with any portion of the connector housing, and offsets are not used. Examples of patents showing cable gripping teeth which penetrate the cable include U.S. Pat. Nos. 2,519,726, 3,375,481, 3,909,101, 4,293,180, 4,363,531. Because the teeth are designed to penetrate the outer insulating jacket of the cable, rather than a braided outer conductor, shielding continuity is not a consideration.

Finally, it is also known to use circuit boards as part of the wire termination arrangement, but the conventional circuit board termination arrangements all require the use of additional dielectric support structures, which raise the height of the front portion of the metal shell and complicate assembly. In contrast, the improved contact structure of the present invention, which involves providing solder pads on a circuit board to which the individual wires of the cable are directly soldered, and a contact grid also formed on the circuit board to which the solder pads are connected by traces, is supported by integral support structures in the shell itself and requires no additional support elements.

In summary, none of the prior connector arrangements discussed suggests a cable connector of the type having both a metal shell to which the outer braid of the cable is electrically connected and a thin wall contact shield, which is capable of providing a continuous low resistance electrical ground path from the outer cable conductor all the way to the shield, with no seams and thus optimal electrical properties, and which eliminates the need for a dielectric contact support structure. In all of the prior connectors of the type with which the invention is concerned, the thin wall shield is a discrete structure from the metal shell, and none of the prior connectors includes integral offset teeth arranged to deform the outer braid of the cable and thereby minimize the resistance of the braid-to-shell interface while at the same time minimizing stress on individual wires within the cable.

SUMMARY OF THE INVENTION

It is accordingly an objective of the invention to provide an electrical connector having a continuous low resistance ground path from the outer braid of an electrical cable to a shield of the connector.

It is also an objective of the invention to provide an electrical connector of the type having a metal shell to which the outer braid of a multiple wire cable is electrically connected and a thin wall front shield with polarizing properties surrounding the connector contacts, and yet which provides a continuous seamless ground path from the cable termination to the front shield and reduced EMI/RF leakage at the interface between the front shield and the metal shell.

It is a further objective of the invention to provide an arrangement for terminating an outer braided conductor of a multiple wire cable to a metal shell having low resistance and which minimizes stresses on the wires in the cable.

It is a still further objective of the invention to provide an electrical connector for a multiple wire cable surrounded by a braided shield, in which the electrical shielding continuity and strain relief properties of the shell are improved without the need for a clamp ring, staple, clamp, or foil.

It is yet another objective of the invention to provide an electrical connector of the type having a metal shell to which the outer braid of a cable is terminated, and a relatively thin wall metal shield surrounding the contacts, and in which establishment of the ground path from the cable braid to the front shield is accomplished by simply fastening a cover to a base portion of the connector, without the need to separately assemble the shield to the metal shell or to use a cable terminating clamp or other cable gripping member.

In addition, it is an objective of the invention to provide a simplified contact structure for an electrical connector in which the need for a dielectric contact supporting structure is eliminated.

Finally, it is also an objective of the invention to provide a shielded electrical connector which can easily be customized to accommodate different sizes of cable while providing improved electrical connection to the outer braid of the cable and without unduly straining individual wires of the cable.

These objectives are achieved, in accordance with the principles of a preferred embodiment of the invention, by providing a shielded connector having a housing made up of a die cast base and cover, and an integral polarizing-type thin wall front shell rather than a separate front shell, in order to provide a continuous ground path between the front shield of the connector and the portion of the backshell at which the shielded cable enters the backshell, and to which the cable shield is electrically connected.

These objectives are achieved, in accordance with the principles of various preferred embodiments of the invention, by providing a shielded connector having a housing made up of a die cast base and cover, and an integral polarizing-type thin wall front shell rather than a separate front shell, by modifying the braid termination structure of the conventional shielded multiple conductor connector by adding offset braid and cable gripping teeth cast to a predetermined dimension in the base and cover, and by providing integral support structures for a circuit board to which the wires of the cable are directly soldered and which extends through an opening between the shell and front shield to form a mating contact grid.

Not only does this structure achieve the advantages of improved shielding continuity between the cable braid and the front shell while at the same time simplifying assembly of the connector, but because the front shield is integral with the metal shell and the dielectric contact support structure is eliminated, the overall profile of the backshell and connector can be reduced. By providing cable deforming gripping teeth, in the form of horizontal ribs in the base and cover having cable deforming edges rather than ribs which merely press against the cable braid, the invention completely eliminates the need for a copper foil of the type depicted in the '415 patent, reduces stresses on wires entering the shell, and yet enables cables of differing sizes to easily be accommodated simply by varying the dimensions of the teeth and size of the opening as necessary, using a fixture with adjustable-in-height cable grip teeth to predetermine the best dimension between the ribs in the housing and cover.

The first and second embodiments of the invention share the above features, applied respectively to a single cable connector and a dual entry connector, each having integral cable gripping teeth and an integral shield. Each of these two embodiments in turn has two disclosed variations, one of which involves the improved contact structure. The variations share the same braid termination structure, cover, and the concept of using an integral trapezoidal front shell, but in the first of the two disclosed variations, the opening in the base between the backshell and the front shield is relative large to accommodate a standard contact configuration having a dielectric supporting structure, while in the second embodiment, the contacts are provided on a circuit board to which the wires of the cable are directly soldered, supporting posts are die cast into the shell, and the opening is a slot dimensioned to fit the circuit board, one side of which forms the contact grid and to the other side of which the cables wires are soldered.

Although two preferred embodiments of the invention, and two variations thereof, are disclosed in detail, however, those skilled in the art will appreciate that numerous additional modifications of the disclosed embodiments may be made without departing from the scope of the invention, for example as relates to the wire termination and contact structures and the shapes of the metal shell and shield, and that the invention is intended to include all such modifications. In addition, it will be appreciated that the contact structure of the second variation of the preferred embodiments of the invention can be used in connector shells other than the integrally die cast connector shell of the present invention.

BRIEF DESCRIPTION OF THE DRAWINGS

FIG. 1 is a perspective view of a connector constructed in accordance with the principles of a first preferred embodiment of the invention.

FIG. 2 is a cross-sectional side view of a first variation of the connector of the first preferred embodiment of the invention.

FIG. 3 is a perspective view showing an interior side of a cover for the connector of the first preferred embodiment of the invention.

DETAILED DESCRIPTION OF THE PREFERRED EMBODIMENTS

Figure 4:
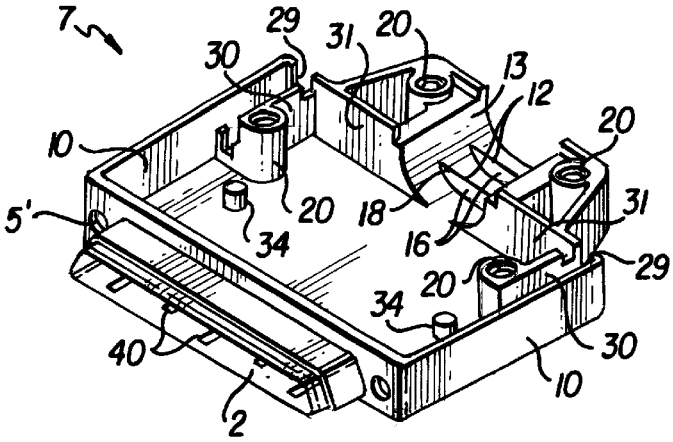
FIG. 4 is a perspective view showing an interior side of a base used in the first variation of the first preferred embodiment invention, viewed towards the rear cable braid termination side of the connector.

As illustrated in FIG. 1, the electrical connector of the preferred embodiment of the invention includes a metal backshell 1 and a front shield 2 extending forwardly of the backshell to surround a board 3 containing a contact grid (not shown). The front shield is referred to as a "thin wall" shield because the walls of this structure are relatively thin in comparison to that of the backshell, both for purposes of compatibility and to reduce weight and materials costs.

The shield 2 is a arranged to fit around a correspondingly shaped protrusion of the corresponding connector or component, the shape of the shield serving to polarize the connector to prevent improper orientation relative to a corresponding connector upon mating. Generally, a trapezoidal or "D" shape is used to provide polarization, although the front shield could also have other shapes.

The backshell 1 includes an interior chamber 60 into which the board 3 extends, and within which the individual wires (not shown) of a cable 4 are terminated to the contact grid. In addition, the backshell supports means for securing the connector to a mating connector, panel, or other structure, which in the illustrated embodiment are screws which pass through openings 5' in the front wall of the backshell, and which include handles 5" extending from the rear of the backshell to facilitate turning of the screws, the rear of the backshell including notches 6 to enable manipulation of the screws without increasing the overall length of the connector assembly. Although the illustrated embodiment uses screws, however those skilled in the art will appreciate that other types of latches may be substituted for the illustrated screws.

As is conventional, the backshell 1 is made up of a base 7 and cover 8, with the base forming the bottom 9 and sidewalls 10 of the backshell, and the cover 8 forming the top. Also, as is conventional, the base and cover are made of a die cast metal, such as zinc. Unlike the conventional connector, however, the front shield is formed integrally with the base, the base and shield being thus formed as a single die cast member having a relatively low profile in comparison with a connector in which the thin wall shield is a separate member.

The cable 4 includes a braided outer conductor 11 which is electrically connected to the backshell by cable gripping teeth 12 in the form of ribs die cast into and extending upwardly from an arc-shaped passage 13 (see FIGS. 4, 5, 7, and 8) formed in the bottom wall of the base, and cable gripping teeth 14 also in the form of ribs die cast into and depending from an arc-shaped passage 15 (see FIG. 3) formed in the cover, arc-shaped passage 13 and 15 forming a generally cylindrical entry passage for permitting entry of the cable into the interior chamber 60 of the backshell where the individual wires of the cable are terminated. Cable gripping teeth 12 and 14 each include a vertical front wall 16 and an oblique rear wall 17 which slopes from a rearward point at the surface of the base or cover forwardly to an intersection with the front wall 16 to form an edge 18 capable of penetrating the braided cable shield 11, the front wall 16 of the teeth taking up rearwardly directed stresses on the cable. It will be appreciated that the edge 18 should be radiused to avoid cutting the outer conductor, but that the radius should be small enough to deform and grip the conductor. A 0.005" radius is, for example, suitable for the illustrated connectors.

The term "offset" as used herein refers to the arrangement of the teeth to be situated, with respect to a horizontal axis extending from the front to the rear through the center of the connector, so that a vertical plane extending from the front wall 16 of one of the teeth intersects the opposite surface of the shell at a point away from the front wall 16 of a tooth extending from the opposite surface. Preferably, the offset is such that a vertical plane extending from the top teeth 14 intersects the base 7 substantially or exactly between the edges of two of the opposite teeth 12, and such that a vertical plane extending from the lower teeth 12 intersects the cover 8 substantially or exactly between the edges of two of the opposite teeth 14, thereby providing a symmetrical offset to minimize stresses on wires passing between the teeth, the path of which is schematically indicated in FIG. 2 by solid line S. Although only two upper and two lower teeth are shown, it will be appreciated that the number of teeth on either the base or cover may be more than two, and that either the base 7 or cover 8 may have an unequal number of teeth while maintaining substantial symmetry.

To minimize the thickness of the front portion of the connector, the passage 15 in the cover is formed as a raised portion 19 which projects above the otherwise planar top surface of the cover. It will be appreciated, however, that the shape of the metal shell may be varied to have shapes other than the illustrated notched rectangular shape with a raised cover portion 19, including variations in which the cover as well as the base includes side, front, and back walls, or variations in which there is no projection above either the planar top or bottom surfaces.

Completing the basic shell assembly of the preferred embodiment are upwardly extending features 20 in the base which contain threaded screw holes, and corresponding openings 21 in the cover through which screws 22 are inserted into the screw holes to fasten the cover onto the base, as well as various ribs which assist shielding at the seams between the base 7 and cover 8, as follows: front and back ribs 23 and 24 on the cover respectively face the inside of front and back walls of the backshell portion of the base, side ribs 25 and 26 face the inside of side walls 10 of the base and include outwardly extending portions 27 and 28 which extend toward the rear edges of the side walls of the base and shield the upper portion of openings 29 between the rear wall of the base and the side walls, the base further including interior side walls 30 and interior back walls 31 to respectively define and shield the rear of the interior chamber 60 of the backshell and the passages for mating screws 5.

Figure 5:
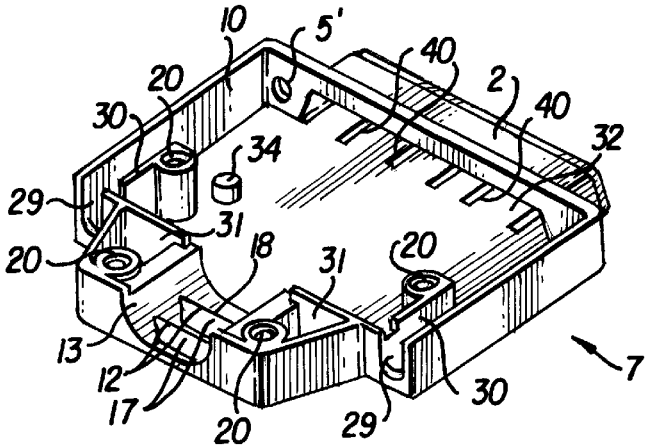
FIG. 5 is a perspective view showing an interior side of the base illustrated in FIG. 4, viewed towards the front mating side of the connector.
Figure 6:
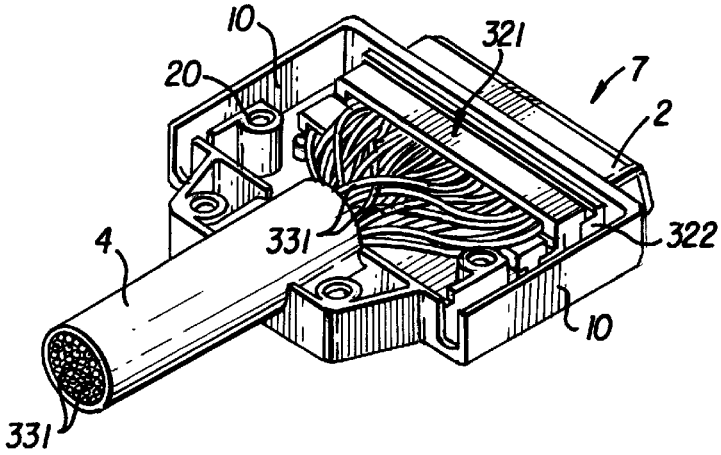
FIG. 6 is a perspective view showing the variation of FIGS. 4 and 5, after termination of the wires of a cable.
Figure 7:
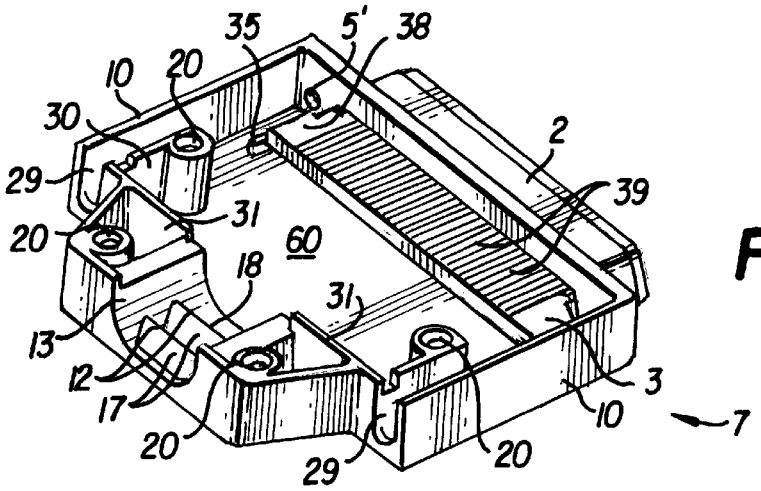
FIG. 7 is a perspective view showing an interior side of a second variation of a base for the first preferred embodiment of the invention, viewed towards the rear termination side of the connector.
Figure 8:
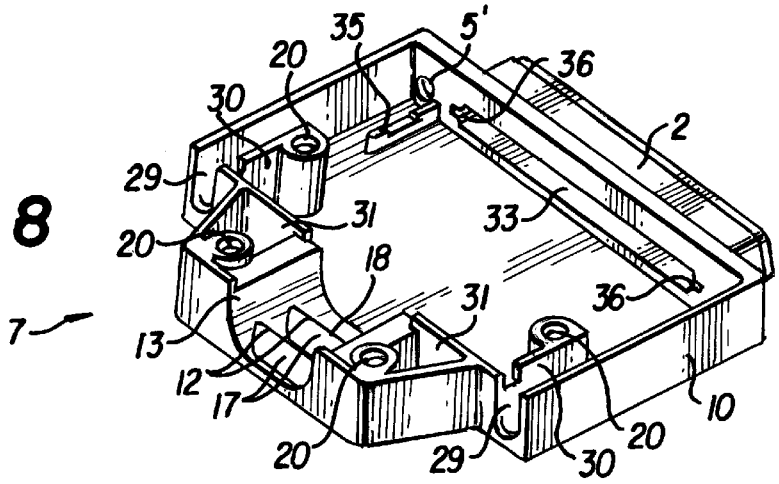
FIG. 8 is a perspective view showing an interior side of the base illustrated in FIG. 6, but with the contact termination circuit board removed to show the opening between the backshell and the contact shield.
Figure 9:
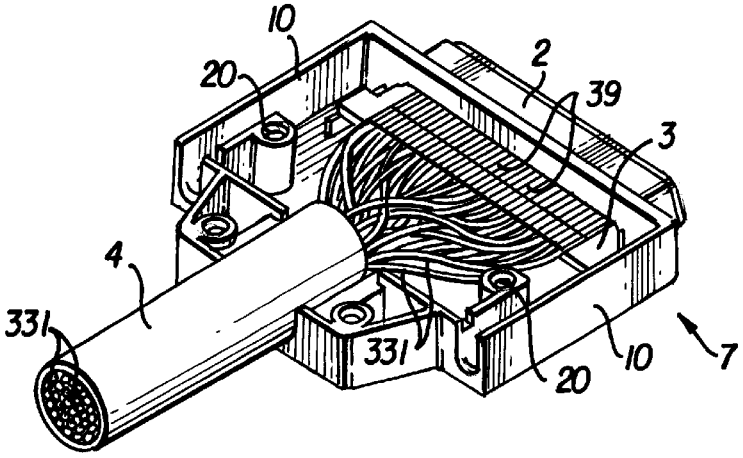
FIG. 9 is a perspective view showing the variation of FIGS. 7 and 8, after termination of the wires of a cable to the circuit board.

The two variations of the preferred embodiment of the invention illustrated respectively in FIGS. 4–6, and 7–9, differ from each other in that the variation shown in FIGS. 4 and 5 is arranged to contain a standard dielectric wire termination arrangement 321 containing insulation displacement contacts (not shown) for terminating wires 331, the termination arrangement including a portion 322 partially seated in an opening 32 (see FIG. 5) and restricted from rearward movement by posts 34, whereas in the variation of FIGS. 7–9, the cable wires 331 are soldered directly to traces 39 which form solder terminations for the wires and which are connected to a contact grid on the board and an opening 33 between the interior chamber 60 of the backshell and the shield can be made sufficiently narrow so as to just permit passage of the board 3 without electrical contact between the shell and the traces. The latter embodiment is especially advantageous in that it eliminates the need for the conventional dielectric supporting structure for the contacts, simplifying assembly and reducing the profile of the front of the connect.

Other than the size of the respective openings 32 and 33 of the variations illustrated in FIGS. 4–6 and 7–9, the bases 7 have only minor differences. In the variation of FIGS. 4–6, posts 34 are cast into the base 7 to retain the dielectric supporting structure for the contacts while in the variation of FIGS. 7–9, the board 3 is directly supported by posts 35 and notches 36 at the edges of opening 33, the board 3 being in the form of a printed circuit board having edges 38 supported by the posts 35 and traces 39 to which the wires of a cable are soldered and which extend through the opening 33 to contact pads (not shown) situated within shield 2 on the front side of opening 33. In each variation, ribs 40 may be provided in the front shield 2 to facilitate electrical contact with a mating connector or component shell.

Figure 10:
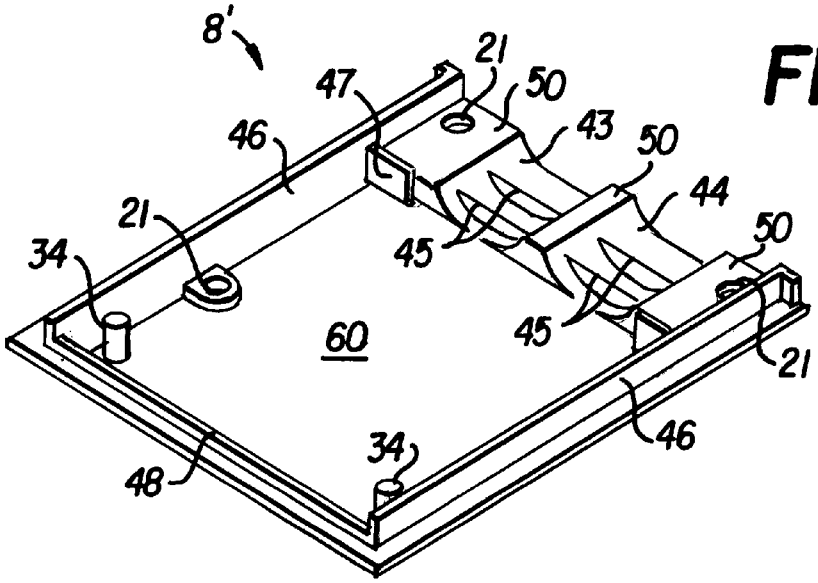
FIG. 10 is a perspective view of the cover of a dual entry connector constructed in accordance with the principles of a second preferred embodiment of the invention.
Figure 11:
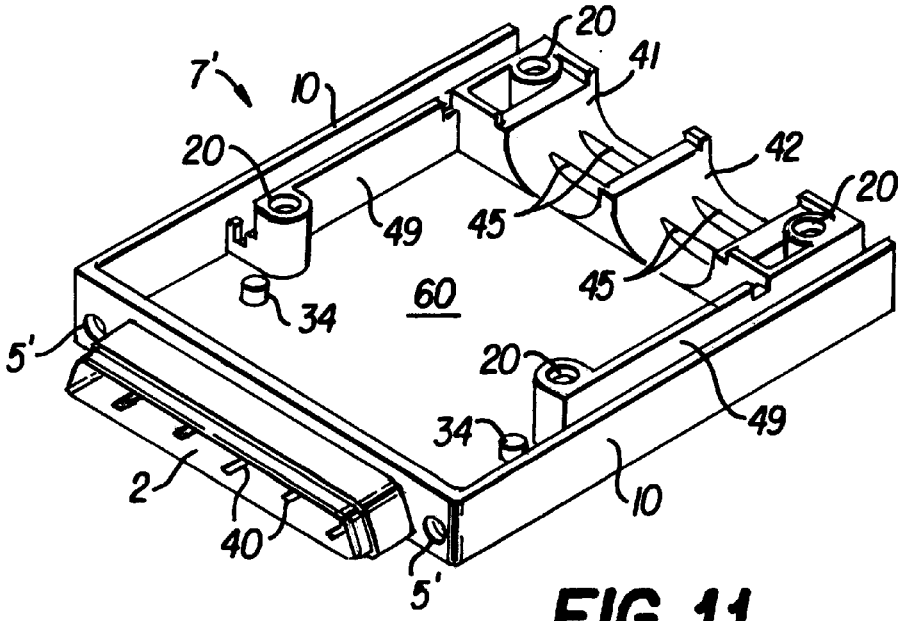
FIG. 11 is a perspective view of a base for the dual entry connector of the second preferred embodiment of the invention.

In a second preferred embodiment of the invention illustrated in FIGS. 10 and 11, the basic base and cover structure shown in FIGS. 1–9 is modified by including a dual cable entry, with two semi-circular passages 41 and 42 in the base 7' and two semi-circular passages 43 and 44 in the cover 8', each of the passages including deforming teeth 45 in the form of horizontal ribs having the same structure as teeth 12 and 14 of the first preferred embodiment of the invention. In addition, because notches can be provided in this embodiment, the arrangement of the respective side, rear, and front shielding ribs and internal walls is simplified since all that is required to shield the seams between the cover and the base are side ribs 46, front rib 48, and rear rib 47 on the cover for preventing radiation leakage through the seams between the cover and the base, and internal side walls 49 on the base for preventing radiation leakage via the mounting screw passages.

In this embodiment, the cable entry passages on both the cover and base are formed by raised portions 50 and 51, respectively, to allow a flat outside surface the shell, although the cover could alternatively be formed to have projecting portions corresponding to portion 19 of the first preferred embodiment of the invention. In addition, although illustrated as including posts 34 corresponding to those of the variation illustrated in FIGS. 4–6, without the board supporting posts 35, it will be appreciated by those skilled in the art that this embodiment could also use a wire termination structure similar to that shown in FIGS. 7–9.

Finally, those skilled in the art will appreciate that the connector and metal shell of both embodiments of the invention may be assembled simply by installing a circuit board or cable termination fixture in the base, stripping an outer jacket of the cable to expose the braided outer shield, further stripping the jacket and braided shield to expose individual wires of the cable, terminating the wires to the circuit board or termination fixture, and attaching the cover to the base with the cable positioned in the entry passage such that, as the cover is attached to the base, the cable gripping teeth deform the braided shield to complete assembly.

Having thus described various preferred embodiments of the invention, and variations of those embodiments, those skilled in the art will appreciate that further variations and modifications of the preferred embodiments may be made without departing from the scope of the invention. It is accordingly intended that the invention not be limited by the above description or accompanying drawings, but that it be defined solely in accordance with the appended claims.

I claim:

1. A die cast metal connector shell, comprising:

a backshell consisting of a base and a cover, said base consisting of a single seamless die cast base member including a bottom wall, a front wall, a rear portion, two side walls, and a front shield integrally formed from said base and extending from said front wall, wherein said base and cover together form a substantially enclosed chamber in which wires of a cable are connected to a set of electrical contacts, wherein said front wall forms a front wall of said chamber and includes an opening through which said set of electrical contacts exits said chamber, wherein said rear portion forms a rear wall of said chamber and includes an interior rear section which defines an interior arc-shaped passage section through which the cable enters the chamber; and wherein the front shield includes a shield wall having a trapezoidal shape, the shield wall extending forwardly from said front wall of said base, wherein the shield wall is thin relative to the front wall of the base, and surrounds said set of electrical contacts extending forwardly from said chamber through said opening in said front wall, and whereby said shield wall is integrally formed from said base to provide continuous shielding from said arc-shaped passage section to said front shield.

2. A metal shell as claimed in claim 1, wherein said base further includes posts die cast into the base for supporting a circuit board, wherein said set of contacts is formed on the circuit board, and wherein said circuit board extends from the chamber through said opening into the shield.

3. A metal shell as claimed in claim 2, wherein said opening includes notches formed at edges of the opening to further support said circuit board.

4. A connector shell as claimed in claim 1, wherein said front shield is D-shaped.

5. An electrical connector, comprising:

a metal shell; and a circuit board positioned in the metal shell, wherein the metal shell comprises:

a backshell consisting of a base and a cover, said base consisting of a single seamless die cast base member including a bottom wall, a front wall, a rear portion, two side walls, and a front shield integrally formed from said base and extending forwardly from said front wall, wherein said base and cover together form a substantially enclosed chamber in which wires of a cable are terminated to a set of electrical contacts, wherein said front wall forms a front wall of said chamber and includes an opening through which said set of electrical contacts exits said chamber, wherein said rear portion forms a rear wall of said chamber and includes an interior rear section which defines an interior arc-shaped passage section through which the cable enters the chamber; and wherein the front shield includes a shield wall having a trapezoidal shape, the shield wall extending forwardly from said front wall of said base, wherein the shield wall is thin relative to the front wall of the base, and surrounds said set of electrical contacts extending forwardly from said chamber through said opening in said front wall, and whereby said shield wall is integrally formed from said base to provide continuous shielding from said arc-shaped passage section to said front shield.

6. A metal shell as claimed in claim 5, wherein said base further includes posts die cast into the base for supporting a circuit board, wherein said set of contacts is formed on the circuit board, and wherein said circuit board extends from the chamber through said opening into the shield.

7. A connector as claimed in claim 6, wherein said opening includes notches formed at edges of the opening to further support said circuit board.

8. A connector as claimed in claim 5, wherein said cover is generally planar and wherein a portion of said cover which defines an upper surface of the entry passage for the cable into the chamber is formed by a raised portion of said cover so that a thickness of a front portion of the backshell is minimized.

9. An electrical connector as claimed in claim 5, wherein said front shield is D-shaped.

* * * * *